US005170934A

United States Patent [19]

Lemoine

[11] Patent Number: 5,170,934

[45] Date of Patent: Dec. 15, 1992

[54] INSTANT DISPOSABLE ICE CHEST

[76] Inventor: Ryne P. Lemoine, 5004 Stratford Rd., W. Little Rock, Ark. 72116

[21] Appl. No.: 898,915

[22] Filed: Jun. 10, 1992

Related U.S. Application Data

[63] Continuation-in-part of Ser. No. 709,386, Jun. 4, 1991.

[51] Int. Cl.[5] ..... B65D 5/02

[52] U.S. Cl. ..... 229/101; 229/103; 229/120.02; 229/240

[58] Field of Search ..... 229/103, 101, 31, 221, 229/240; 62/371, 457.4, 457.5; 206/542

[56] References Cited

U.S. PATENT DOCUMENTS

| | | | |
|---|---|---|---|
| 2,810,506 | 10/1957 | Kessler | 229/101 |
| 3,119,494 | 1/1964 | Rosenstiel | 229/103 |
| 3.150,812 | 9/1964 | Sabol | 229/103 |
| 3,554,402 | 1/1971 | Lock | 229/240 |
| 3,568,877 | 3/1971 | Mastrud, Jr. | 229/101 |
| 3,659,772 | 5/1972 | Dorsey et al. | 229/3.1 |
| 3,886,901 | 6/1975 | Zeitter | 229/221 |
| 3,976,241 | 8/1976 | Bemiss | 229/221 |
| 4,126,261 | 11/1978 | Cook | 229/120.02 |
| 4,328,923 | 5/1982 | Graser | 229/101 |
| 4,586,649 | 5/1985 | Webinger | 229/240 |
| 4,790,474 | 12/1988 | Mitsuyama | 229/120.02 |
| 4,974,731 | 12/1990 | Wood | 229/117.13 |
| 5,020,337 | 6/1991 | Krieg | 229/103 |

*Primary Examiner*—Allan N. Shoap
*Assistant Examiner*—Christopher J. McDonald
*Attorney, Agent, or Firm*—Stephen D. Carver

[57] ABSTRACT

A can or bottle drink carton comprising expandable compartments affixed to its opposite sides. Tear strips associated with each compartment are activated to facilitate deployment of the compartments. The carton can be converted into an ice chest by unzipping a tear-strip on each side of the carton, lifting ice cover flaps on both sides of the carton, popping out expandable ice compartments on both sides of the carton resulting in compartments ready to receive ice to keep the can or bottle drinks cold. The preferred embodiment would not employ the tearstrip nor the flap created thereby. Rather, it would facilitate securing the compartments closed against the sides of the chest with impermeable glue. This allows the compartments to be deployed by tugging the compartment free from the side of the chest. After use the carton is disposable and recyclable.

8 Claims, 6 Drawing Sheets

INSTANT DISPOSABLE ICE CHEST

CROSS REFERENCE TO RELATED APPLICATION

This application is a continuation-in-part of my previously filed application Ser. No. 07/709,386, entitled Instant Disposable Ice Chest, filed Jun. 4, 1991.

BACKGROUND OF THE INVENTION

The present invention relates to a can or bottle drink carton designed to expand into a larger carton in order to make room for ice to keep rinks cold. More particularly, this invention relates to systems in which the same carton in which the can or bottle drinks were purchased can be used for cooling. It is believed best classified in U.S. Class 229 Subclasses 101 or 103.

Various types of ice chests are made to keep can and bottle drinks cold. Various types of cartons are made to store and display can and bottle drinks. Both types of containers work well for their intended purposes. However, the present invention combines them into one ice chest carton design. This invention is a quick and easy way to purchase can or bottle products and an ice chest to keep them cold at one time.

The prior art discloses expandable cardboard containers that allow the products in these containers to be iced. These containers are generally expanded by means of a pull tab to release panels which may then be folded out and interlocked with one another. In some instances the panels are secured by a device such as a band or a button.

Rosenstiel U.S. Pat. No. 3,119,494 issued Jan. 28, 1964 discloses a convertible package that is generally intended to be a box for a bottle of champaign or wine. It may be deployed into a funnel shaped ice bucket to hold the bottle of wine or champaign. This package is made from a single piece of fanfolded cardboard and employs button which pass through alternate layers of the cardboard when the package is undeployed and deployed.

Graser U.S. Pat. No. 4,328,923 discloses a picnic cooler container which is basically a rectangular cardboard box with expanding pockets on its ends and a plastic barrier inside the box.

Dorsey U.S. Pat. No. 3,659,772 discloses a method to treat cardboard to make it water resistant.

Krieg U.S. Pat. No. 5,020,337 discloses a combination ice package and expandable cooler which basically comprises a cardboard box in which the top is expandable to allow ice to be spread over the to of the contents of the carton.

Kessler U.S. Pat. No. 2,810,506 discloses a device similar to Krieg's.

It is therefore desirous to provide an instant ice chest package that avoids cumbersome arrangements and allows a single pull of a tab and/or tug on the compartment to deploy each compartment, ready to receive ice. Further advantages desired include a greater area of exposure to the ice, the absences of non-biodegradable barriers, ability to package multiple cans or bottles and transportability while iced.

SUMMARY OF THE INVENTION

The present invention is designed to keep can and bottle drinks cold in the original carton they were purchased.

This invention can be practiced on a six pack, twelve pack, or 24-pack carton to facilitate cooling. My design allows the carton to instantly expand to form an ice chest. It also acts as the original storage carton for the can or bottle drinks before it is purchased and expanded into an instant ice chest. The carton is also disposable.

The carton can be opened up at any time by unzipping tearstrips securing the ice compartments on both sides, lifting the ice cover flaps on both sides and popping out the expandable ice compartments thereby releasing the non-permanent glue on both sides. In the preferred embodiment the compartments do not employ tearstrips or flaps. Rather, the compartments are secured to the sides of the carton by impermanent glue. The compartments in this best mode are deployed by tugging them free from the sides of the carton. The ice compartments may then be filled with ice in order to keep the can or bottle drinks cold. The inside bottom and inside sides are coated with a thin water resistant wax or plastic sealer to prevent melted ice from seeping through the bottom of the cardboard carton.

Therefore, it is a broad objective of this invention to provide an instant disposable ice chest that can conveniently be deployed, used and disposed of afterwards.

A narrower objective of the present invention is to provide an instant disposable ice chest that can be deployed without the use of folding or reslotting cardboard by the consumer.

A further objective of the invention is to provide a disposable ice chest compartment which may be affixed to a conventional twelve or twenty-four pack at the time of manufacture or packing.

One objective of this apparatus is to provide an instant disposable ice chest that is fully and economically recyclable without extensive separation of component materials.

Another objective is to provide a transportable instant disposable ice chest.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and in which like reference numerals have been employed throughout to indicate like parts in the various views.

DETAILED DESCRIPTION

Figure 1:
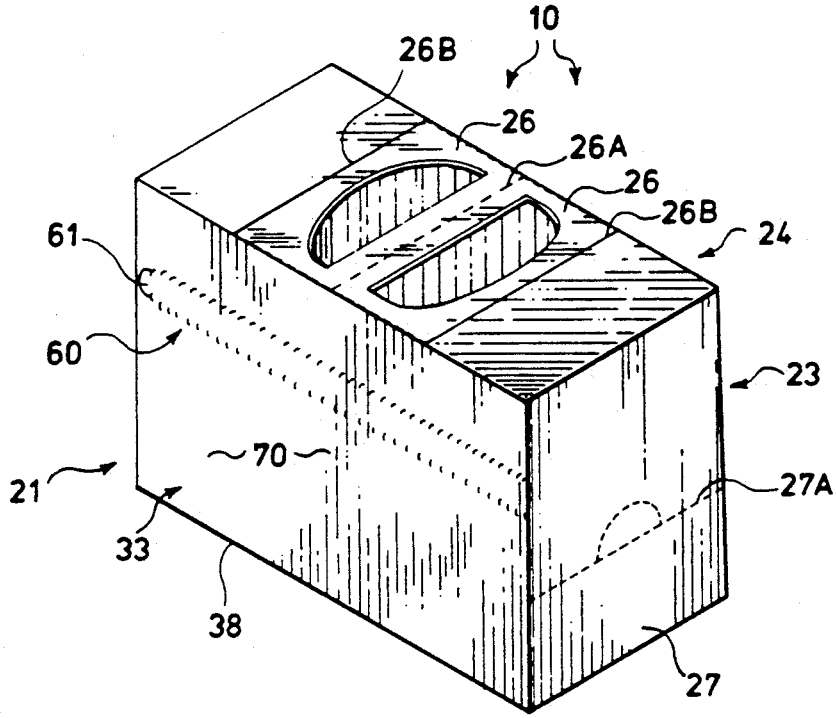
FIG. 1 is an isometric view of the claimed Instant Disposable Ice Chest.
Figure 2:
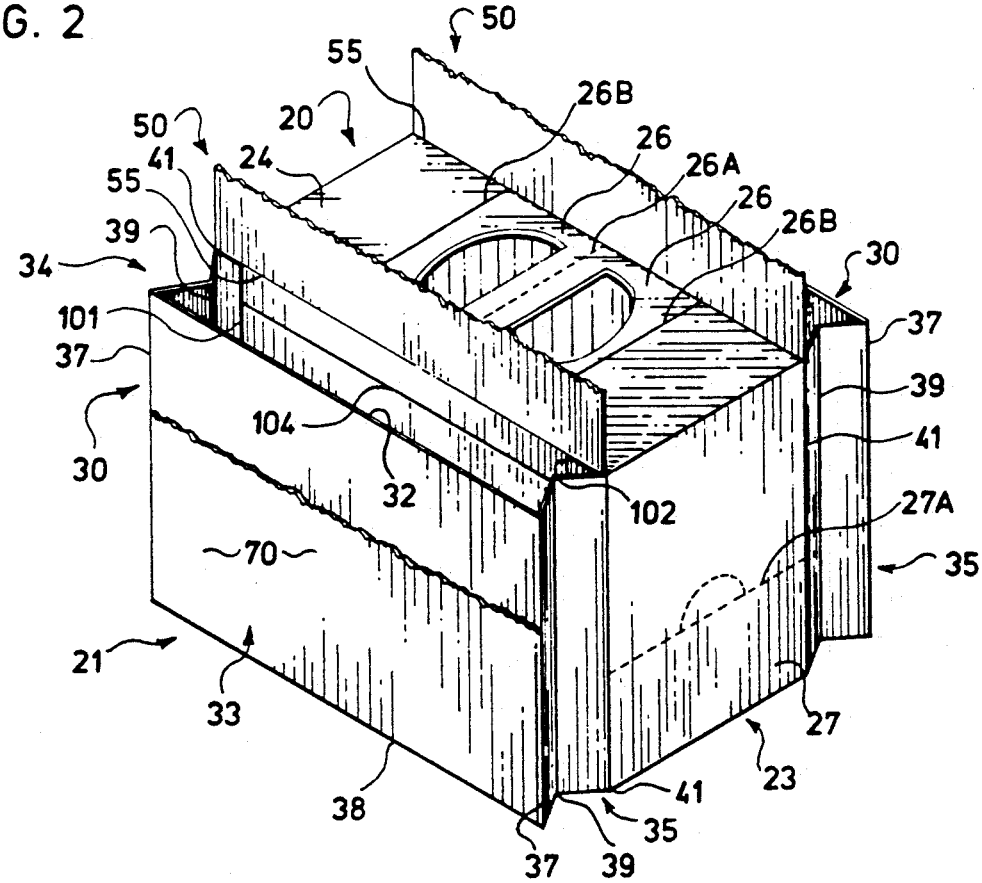
FIG. 2 is an isometric view thereof, with the expandable compartments and flaps deployed.
Figure 8:
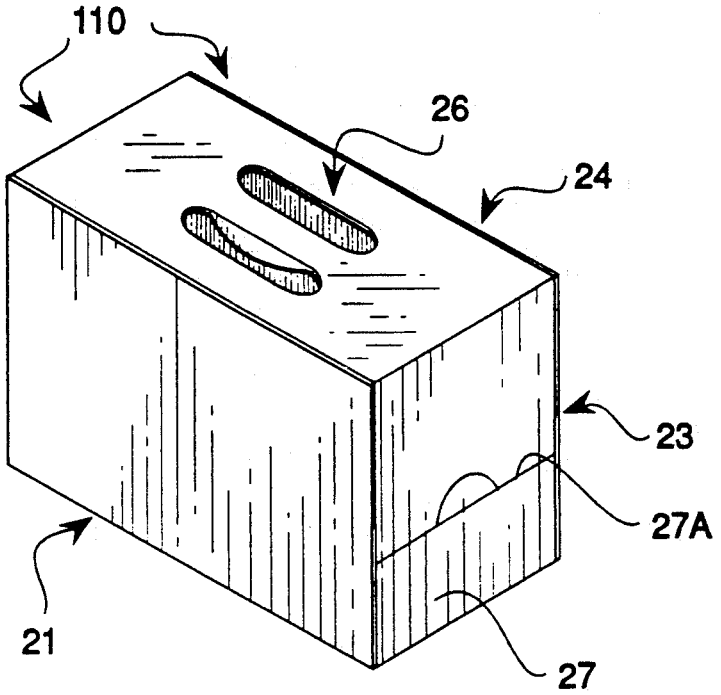
FIG. 8 is an isometric view of the best mode of the claimed Instant Disposable Ice Chest.

With reference now to the accompanying drawings my new Instant Disposable Ice Chest is broadly designated by the reference numeral 10. The best mode is designated by the reference numeral 110. As seen in FIGS. 1 and 8, before the ice chest is expanded it is adapted to generally appear to be part of a normal twelve or twenty-four beverage pack.

With reference to FIGS. 1–13 the ice chest 10 or 110 preferably comprises a box designated by the reference numeral 20, which is generally in the form of a parallelepiped. Box 20 is similar to conventional twelve or twenty-four pack cartons, the sizes of which vary. The unique expandable compartments 30 and 130 are affixed to the sides of the box 20 as will hereinafter be described. Therefore, these compartments 30 and 130 would be produced in various sizes to accommodate different package sizes.

The features of twelve and twenty-four packs vary but generally include those described below and illustrated in the drawings in various configurations. The central box has sides 21, ends 23, a top 24 and a bottom 25. Defined within the top 24 are carrying handles 26 which may be deployed by tearing along line 26A and folding the handles 26 back along fold lines 26B or into the box. At least one end 23 of the main box has a drink Z dispensing door 27 defined by perforations 27A in the end 23. Each side is comprised of an expandable compartment 30 or 130 and a wall 31, which forms the side of the "inner" or conventional twelve or twenty-four pack.

Figure 5:
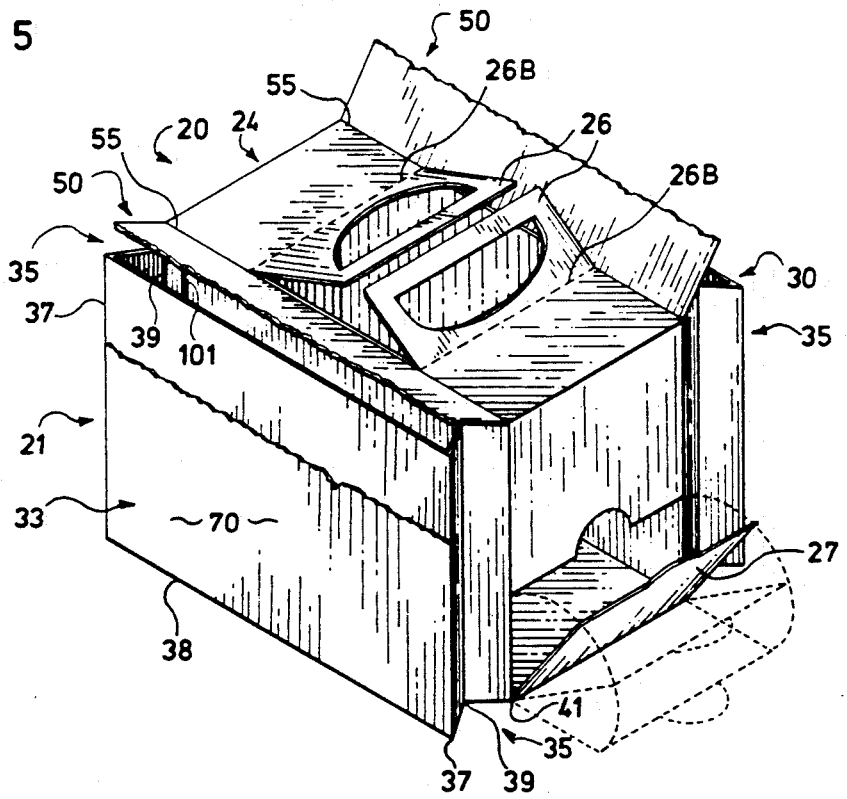
FIG. 5 is an isometric view thereof, showing the operation of the conventional components of the drink box as well as the operation of the expandable compartments and the flaps.
Figure 6:
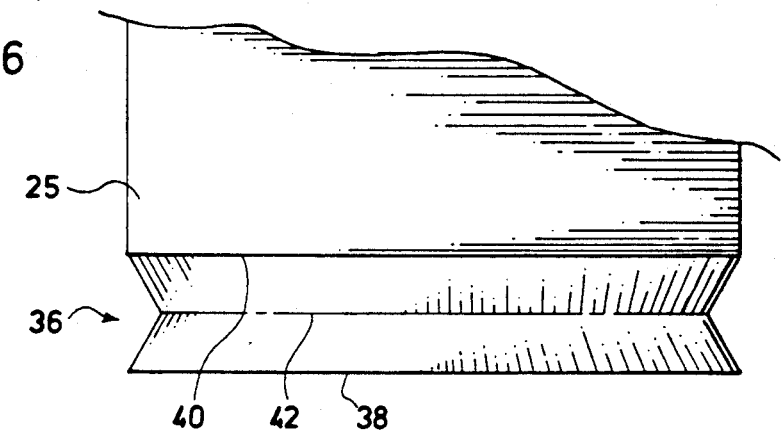
FIG. 6 is a fragmented bottom view of the ice chest, showing the pleat along the bottom of a expandable compartment.
Figure 7:
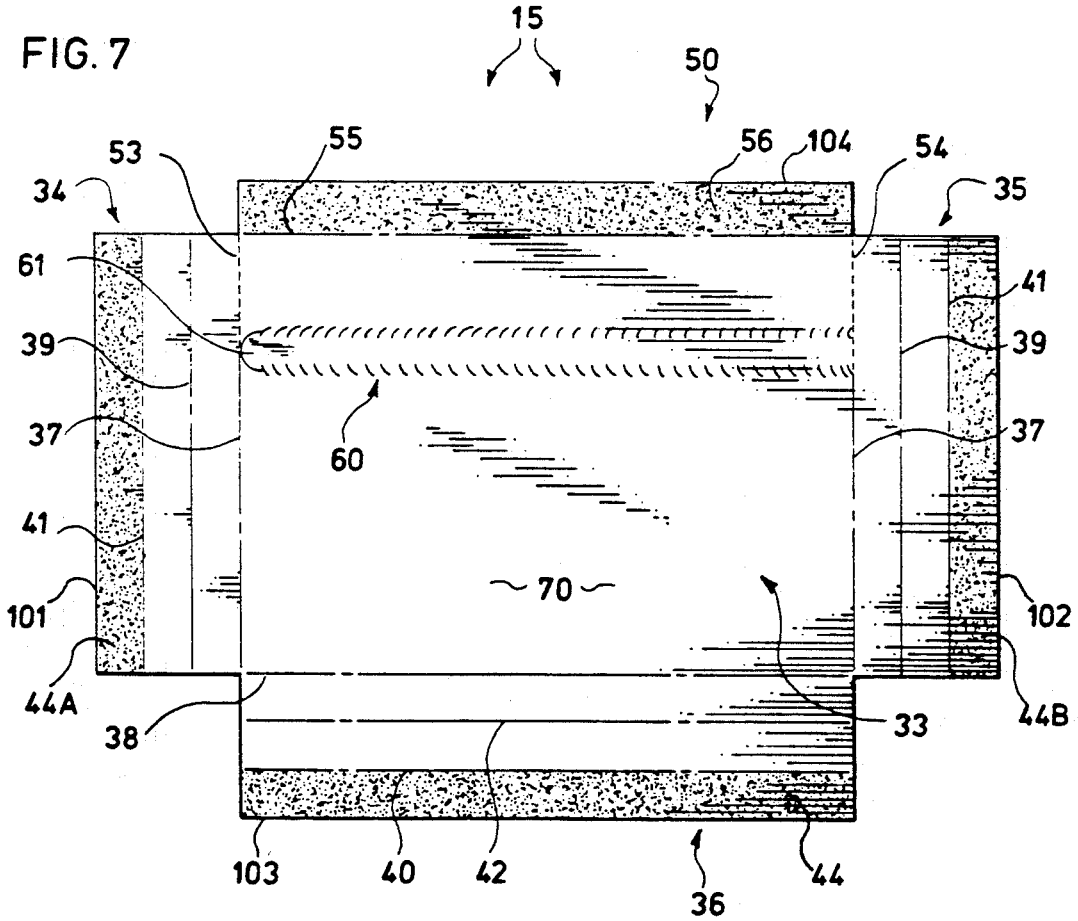
FIG. 7 is a plan of the blank from which a expandable compartment is formed.

With reference primarily directed to FIGS. 5 and 7, the expandable compartments 30 are comprised of a central panel 33, a left gusset 34, a right gusset 35, a bottom gusset 36 a tearstrip 60 and a flap 50. Each compartment is created from a single blank of two-ply cardboard as shown in FIG. 7 by general reference numeral 15. The gussets 34 and 35 are formed by folding a blank along fold lines 37 and 41 and scoring the blank along scoreline 39. The bottom gusset 36 has similar folds 38 and 40 and a score 42. A glue strip 44A–44B is formed adjacent the outermost edges 101, 102 and 103 respectively of the gussets 34–36. The waterproof permanent glue on strips 44A–44C affix the expandable compartment to the side of the main box 20. Accordion-like pleats are thus formed so the compartments can be moved resiliently toward or away from the box sides. The interior surface of the central panel 33 is detachably affixed to the side of the main box 20 by non-permanent glue applied at its rear slightly below the top edge of the main box 20.

The flap 50 is defined from the blank 15 by a tearstrip 60, which penetrates the first cardboard ply of the front face 70 of the central panel 33. The flap 50 is further separated from the central panel 33 by slits 53 and 54 which also only penetrate the first layer of the two-ply cardboard blank 15. These slits 53 and 54 are coincident with the left and right gusset folds 37 from the upper fold 55 of the blank to the tearstrip 60. A third slit on the back face of the blank is coincident with fold 55. Fold 55 is parallel with and in close proximity to the upper edge 104 of the blank, forming a glue strip 56 that adheres to wall 31.

Figure 9:
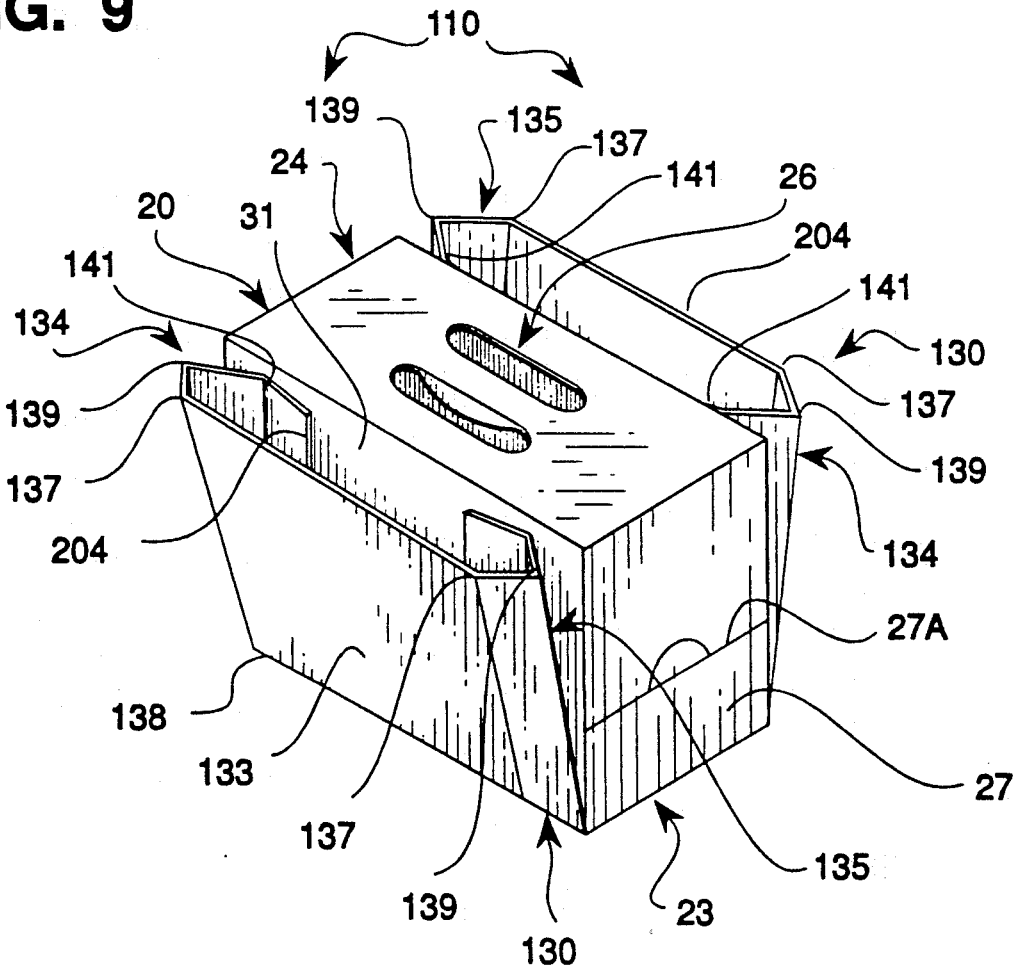
FIG. 9 is an isometric view of the best mode with the expandable compartments deployed.
Figure 10:
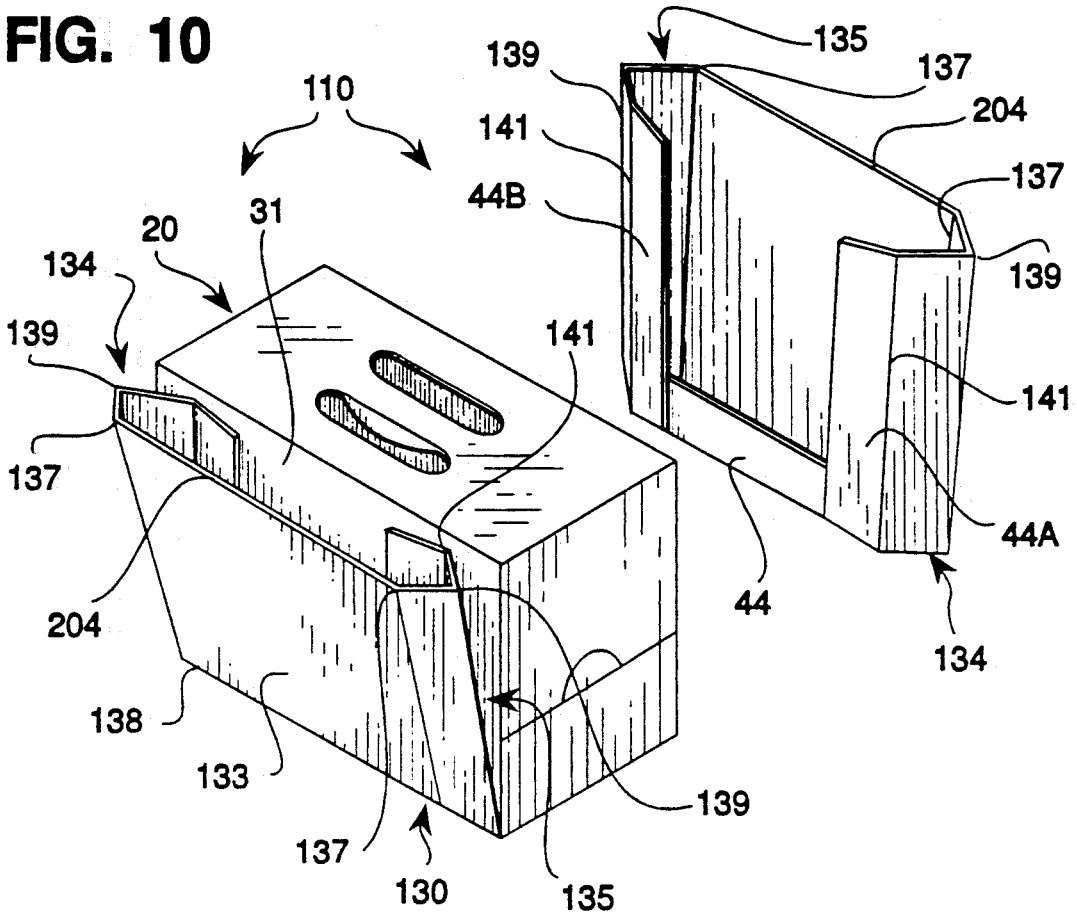
FIG. 10 is a partially exploded Isometric View of the best mode, illustrating the configuration of the expandable compartment.

The best mode of the present invention is illustrated in FIGS. 8 through 13 the lower gusset of the above described compartments 30 is not employed, nor is the aforementioned tearstrip 60 and flap 50. With reference primarily directed to FIGS. 9 and 10, the best mode expandable compartments 130 are comprised of a central panel 133, a left gusset 134 and a right gusset 135.

Figure 13:
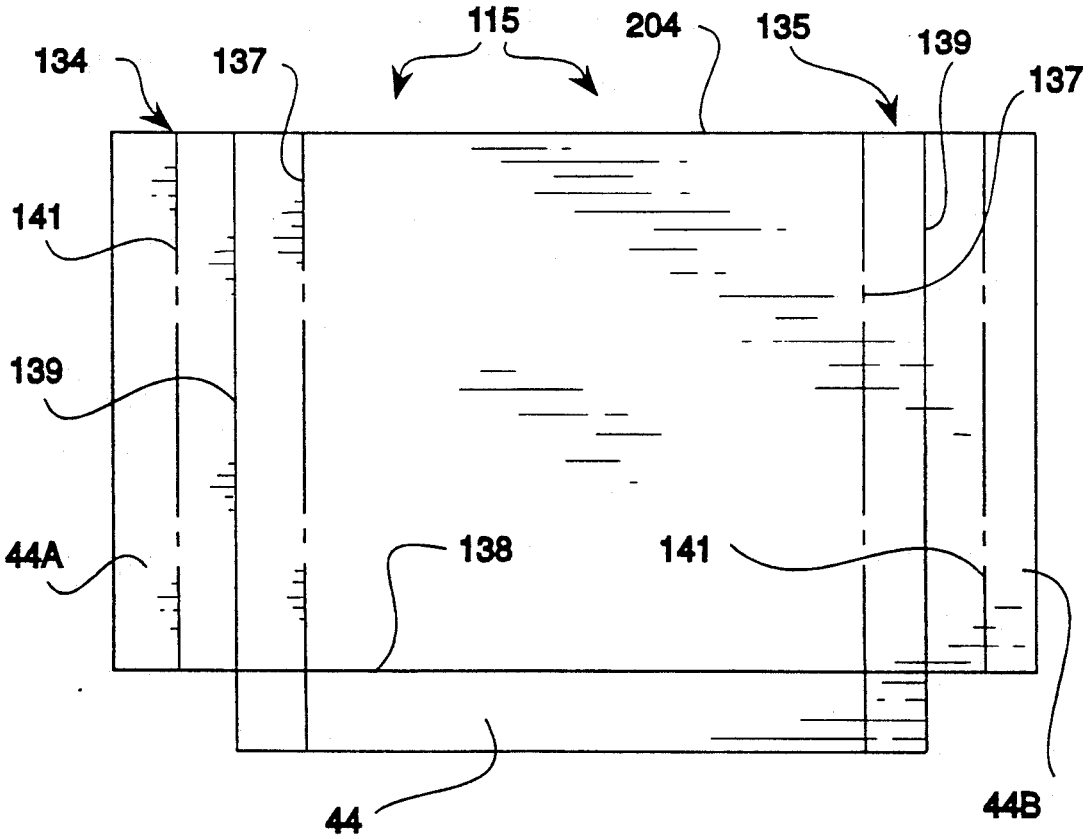
FIG. 13 is a plan of the blank from which the expandable compartment for the best mode of the present invention is formed.

Each compartment is created from a single cardboard blank indicated in FIG. 13 by general reference numeral 115. The blank 115 is illustrated with its exterior surface facing the viewer. The gussets 134 and 135 are formed by folding the blank 115 along fold lines 137 and 141 and scoring the blank along scoreline 139. The bottom of the blank has similar a fold 138. Glue strips 144, 144A and 144B are formed adjacent the outermost edges 201, 202 and 203 of the gussets 134 and 135 and the bottom fold 138 respectively. Permanent glue on the front faces of strips 144, 144A and 144B affix the expandable compartment 130 to the side of the main box 20. Accordion-like pleats are thus formed so the top of the compartments can be moved resiliently toward or away from the box sides.

The interior surface of the central panel 133 is detachably affixed to the side of the main box 20 by non-permanent glue applied at its rear slightly below the top edge of the central panel 204. This configuration reduces production costs and simplifies assembly and use of the chest in contrast to the preceding embodiment.

Alternatively, a waterproof coating or wax can be applied to the inner surfaces defined by the expandable compartment 30 or 130 and the wall 31. These will be the areas in contact with the moisture created by the ice.

Another alternative is to partially or completely do away with the wall 31 except for the areas providing gluing surfaces that are required by the expandable compartment 30 or 130.

If the wall 31 is retained, the ice will not be in direct contact with the beverages inside. However, when the sides of the box are removed the ice directly contacts the beverages inside. A compromise is to form relatively small spaced apart openings in the wall 31, thereby allowing some contact between the ice and the beverages within. This latter design will allow the structural strength of the main box 20 to remain more or less intact.

Figure 3:
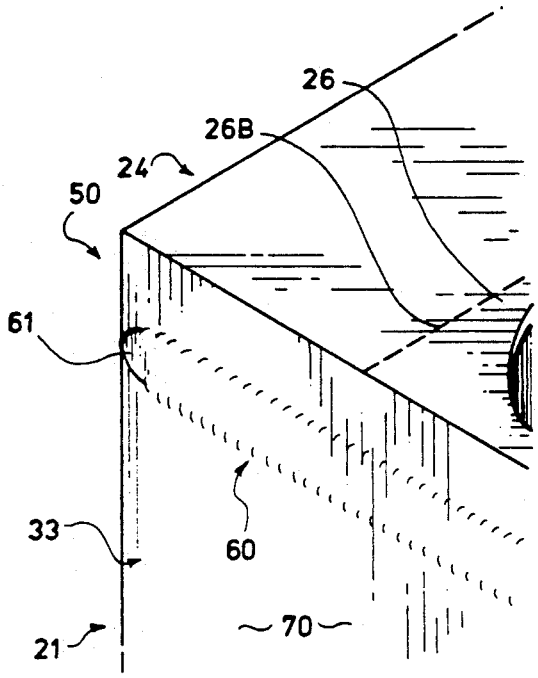
FIG. 3 is an enlarged, fragmentary detail view showing a pull tab
Figure 4:
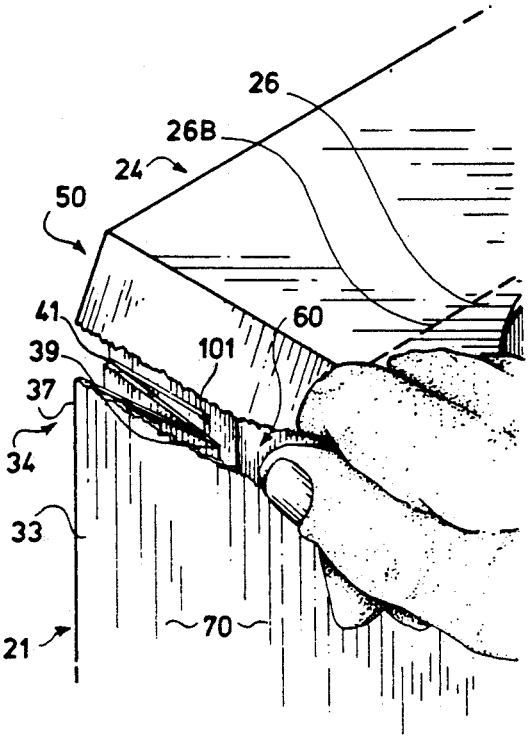
FIG. 4 is an enlarged, fragmentary detail view showing operation of a tearstrip.

The first described embodiment of the instant disposable ice chest is deployed as shown in FIGS. 3 and 4. First the tab 61 is pulled removing the tearstrip 60. This frees and releases flap 50 and; the top edge 32 of the expandable compartment 30 is uncovered. To expand the compartment 30 one needs only to exert a gentle tug on the central panel 33 thereby releasing it from the hold imposed upon it by the non-permanent glue. FIG. 5 shows further deployment of the dispensing door 27 and carry handles 26 of the conventional twelve or twenty four pack main box 20 in conjunction with the deployment of the expandable compartments 30 and the flap 50.

Figure 11:
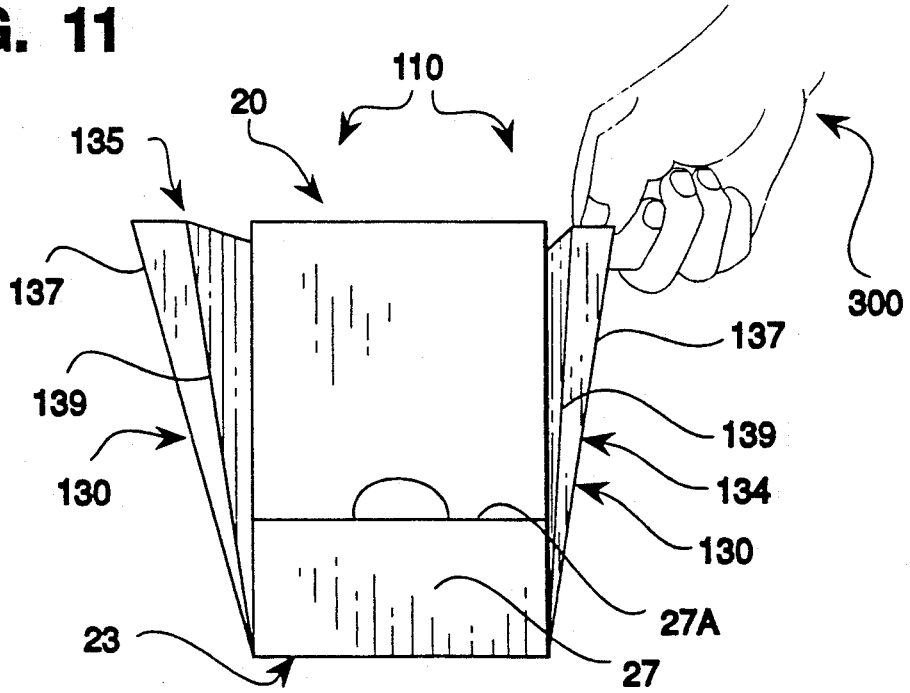
FIG. 11 is an side view of the best mode illustrating deployment of an expandable compartment.
Figure 12:
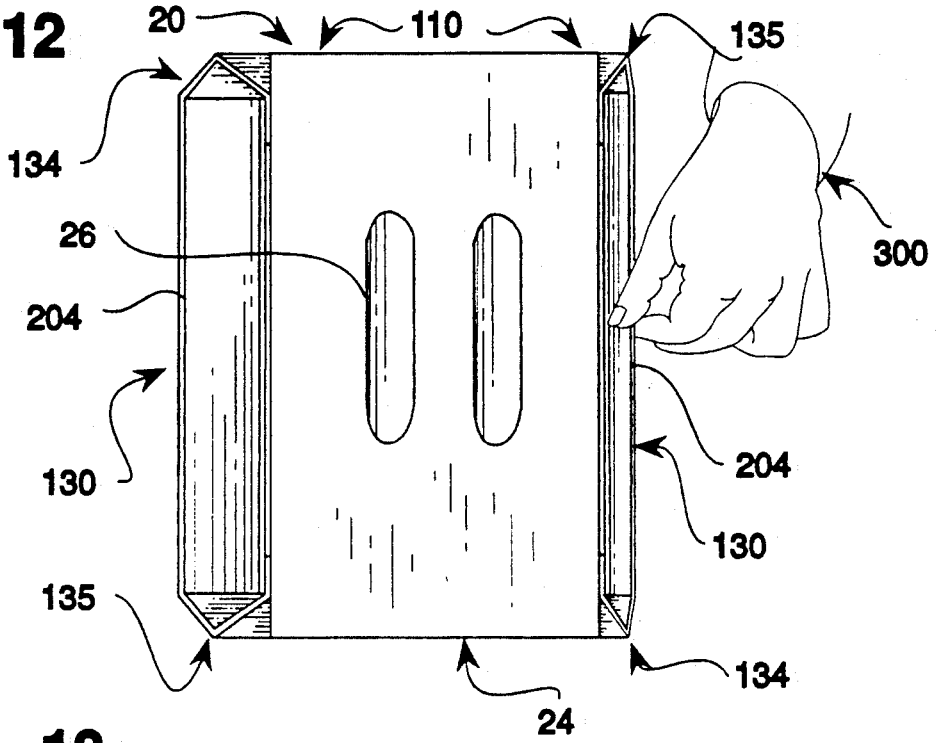
FIG. 12 is top view of the best mode illustrating deployment of an expandable compartment.

Deployment of the best mode by an individual 300 is illustrated in FIGS. 11 and 12. The cooling compartments of the ice chest are deployed by pulling the compartment panel 133 free from the side of the box, overcoming the hold of the impermanent glue.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A disposable carton comprising:

box means for confining a plurality of articles, said box means comprising two sides, a top, a bottom, and two spaced apart ends;

wherein each of said sides comprise expandable compartment means selectively deployable to define an interior for receiving and storing ice, said compartment means expandably affixed to the sides of said box means and comprising a face semipermanently glued to the exterior of said box side;

flap means for covering said compartment means, said flap means closably disposed on said sides; and, tearstrip means for convertibly securing said flap means to said compartment means.

2. The carton as defined in claim 1 wherein said interior is coated to prevent leakage.

3. A convertible ice chest carton comprising:

box means for containing cans or bottles, said box means comprising two sides, a top, a bottom and two ends;

said sides comprising a selectively deployable outer compartment and a wall extending between the top, bottom and ends of said carton;

said expandable compartment comprising a central panel, a left gusset and a right gusset, wherein said compartment is formed from a single blank of multi-ply cardboard having left, right, lower and upper edges and front and back faces;

a plurality of first folds defined in said blank between said central panel and each of said gussets;

said gussets comprising outer glue strips adapted to be adhered to said box means, second fold lines adjacent glue strips, and scores between said first and second fold lines for enabling accordion-like folding; and, said panel is temporarily, yieldably glued to said carton.

4. The ice chest carton as defined in claim 3 wherein said expandable compartment further comprises a tearstrip adapted to be activated to define a flap, and a bottom gusset.

5. The ice chest carton as defined in claim 4 wherein said flap is defined between the tearstrip, a slit penetrating an inner ply of said blank, and a glue strip formed by a third fold parallel to and closely spaced from the upper edge of the blank.

6. The ice chest carton as defined in claim 5 wherein said tearstrip is parallel with and separated from the upper edge of the blank and penetrates one ply of the front face of the blank, two of said slits in the front face of said blank are coincident with said first folds from said upper edge to said tearstrip, and said flap glue strip is permanently glued to said carton.

7. The convertible ice chest carton of claim 6 wherein the interior defined by said expandable compartment and said wall is coated to prevent leakage.

8. The ice chest carton as defined in claim 7 wherein said expandable compartment further comprises a tearstrip adapted to be activated to define a flap, and a bottom gusset.

* * * * *